US010104984B2

(12) United States Patent
Hagglund

(10) Patent No.: US 10,104,984 B2
(45) Date of Patent: Oct. 23, 2018

(54) EXPANDABLE MATTRESS COVER

(71) Applicant: Tualatin Sleep Products, Inc., Tualatin, OR (US)

(72) Inventor: John E. Hagglund, Newberg, OR (US)

(73) Assignee: Tualatin Sleep Products, Inc., Tualatin, OR (US)

( * ) Notice: Subject to any disclaimer, the term of this patent is extended or adjusted under 35 U.S.C. 154(b) by 0 days.

(21) Appl. No.: 15/597,865

(22) Filed: May 17, 2017

(65) Prior Publication Data

US 2017/0332805 A1 Nov. 23, 2017

Related U.S. Application Data

(60) Provisional application No. 62/337,989, filed on May 18, 2016.

(51) Int. Cl.
*A47C 31/00* (2006.01)
*A47C 31/10* (2006.01)

(52) U.S. Cl.
CPC ..... *A47C 31/105* (2013.01)

(58) Field of Classification Search
CPC ..... A47C 31/105; A47C 31/00
USPC ..... 5/740, 738, 657, 640
See application file for complete search history.

(56) References Cited

U.S. PATENT DOCUMENTS 1,271,672 A * 7/1918 Crowley ..... A47C 31/007 5/722
6,804,848 B1 * 10/2004 Rose ..... A47C 27/082 5/706
2007/0022540 A1 * 2/2007 Hochschild ..... A47C 27/001 5/727

* cited by examiner

*Primary Examiner* — Fredrick C Conley
(74) *Attorney, Agent, or Firm* — Chernoff Vilhauer LLP

(57) ABSTRACT

A mattress and an arrangement for altering a mattress' thickness or firmness, with an outer covering with a perimeter aligned with the perimeter of a mattress to be altered; an inner compressible material held within the covering; and a pocket is sized to accept a mattress insert, and wherein the pocket is attached on at least one side to a mattress.

4 Claims, 1 Drawing Sheet

EXPANDABLE MATTRESS COVER

CROSS-REFERENCE TO RELATED APPLICATION

This application claims benefit of U.S. Provisional Application No. 62/337,989 filed May 18, 2016, the entire disclosure of which is hereby incorporated herein by reference for all purposes.

BACKGROUND OF THE INVENTION

The subject matter of this application relates to mattresses and mattress covers.

SUMMARY OF THE INVENTION

Does not apply.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
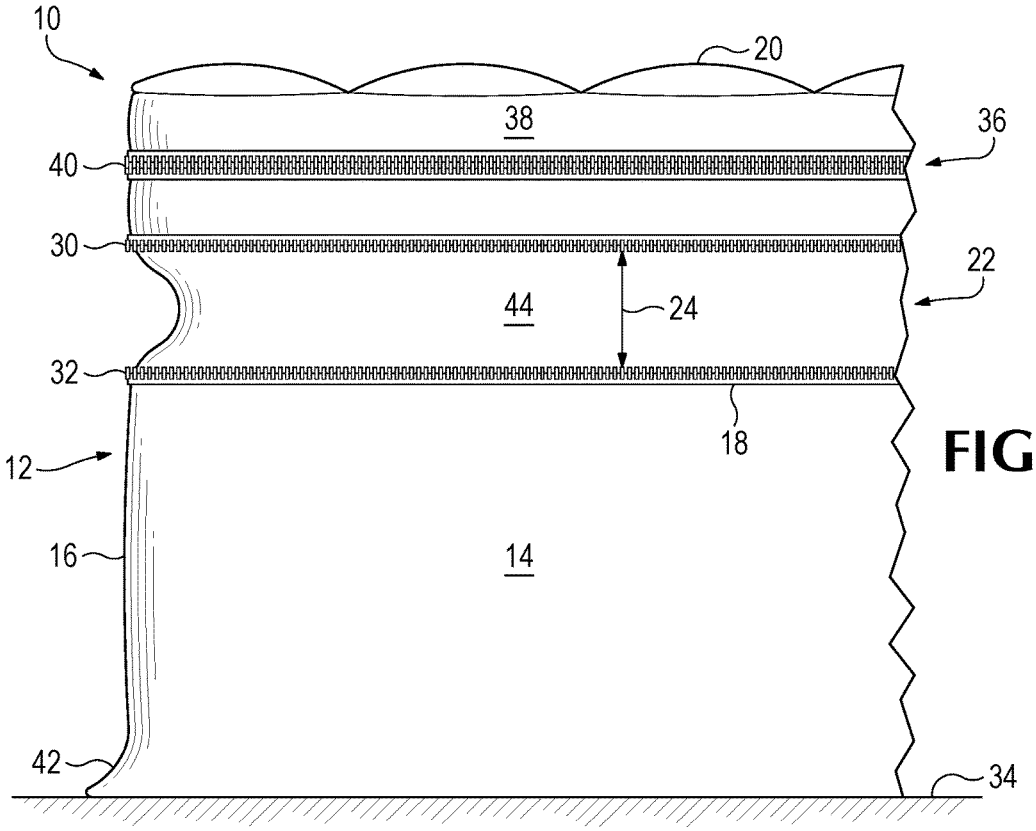
FIG. 1 shows a side view of a portion of the mattress cover with the expander open.

FIG. 1 herein shows an embodiment of a mattress cover, shown generally at 10, in use with a mattress, shown generally at 12. A complete mattress configuration often includes a bottom panel 14, a mattress border 16, and a center panel 18, on which rests a quilted top panel 20. The bottom panel 14 may include an innerspring or non-innerspring support unit, and have a substantially rectangular shape or surface area (not shown) and extend along a floor surface 34. The bottom panel 14 may also have a perimeter that is defined by the outer edges of the mattress border 16. The center panel 18 and the quilted top panel 20 may have the same shape as the bottom panel 14 so that the center panel and the quilted top panel can stack on top of the bottom panel 14 without any overhang. The bottom panel 14 and the center panel 18 may both have thicknesses and physical characteristics that are specifically selected based on a manufacturer's or user's needs and desires. A quilted top panel 20 may similarly have a thickness and filling that depend on the manufacturer's needs and desires. The mattress 12 may be permanently covered with traditional upholstery and fabric covers, and may have a permanently attached upper sewn cover or quilted panel 20. In addition, the bottom panel 14 may have reinforcement boundaries 42 to provide further reinforcement of the mattress structure.

In one embodiment of the present invention, an expandable portion 22 may be located between the quilted top panel 20 and the center panel 18, and may be generally incorporated into the mattress cover 10. The expandable portion 22 may be a generally horizontal portion having a similar rectangular shape as a corresponding bottom panel 14, having a first, expanded thickness 24 and a second, closed thickness 26. The expandable portion 22 may be filled with a compressible filling or material, such as a memory foam. Compression of a compressible filling may cause the filling to feel firmer than how the filling or mattress feels prior to compression. Therefore, in some embodiments, when the expandable portion 22 is in the closed position as shown in FIG. 2, the mattress 12 may feel firmer to a user than when the expandable portion 22 is in the expandable position, shown in FIG. 1.

The expandable portion 22 may include an outer covering 44 that holds the compressible filling or material. The expandable portion may also have a perimeter that is substantially aligned or the same as the perimeter of the bottom panel 14, so that the expandable portion 22 may be attachable to such a mattress 12 without any overhang of the center panel 18 or the expandable portion 22.

Figure 2:
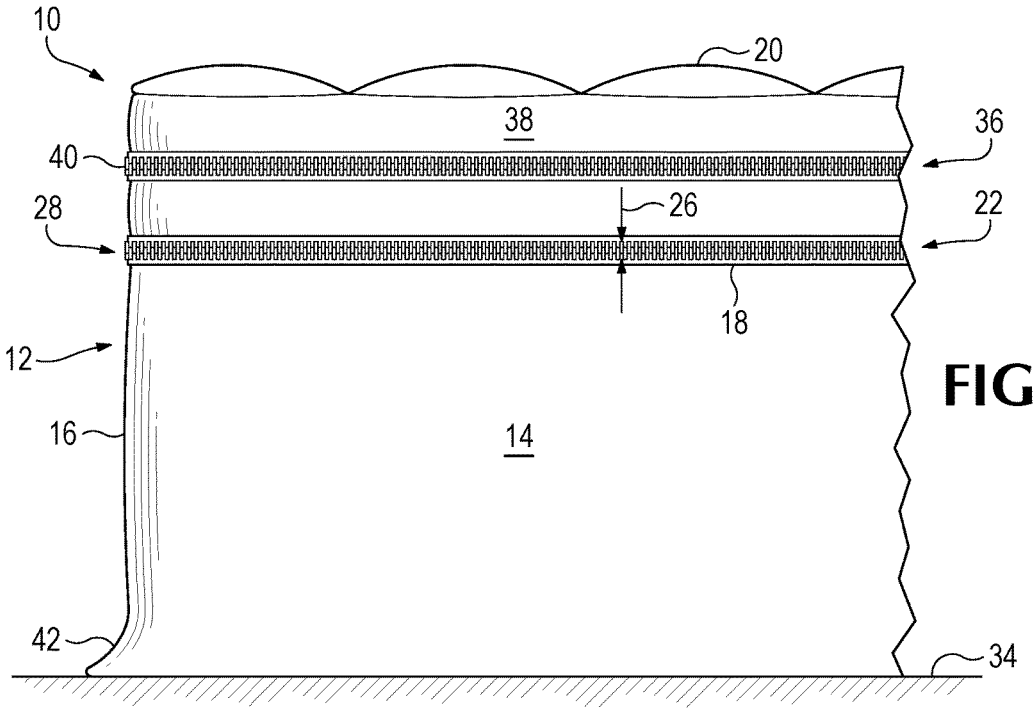
FIG. 2 shows a side view of the portion of the mattress cover shown in FIG. 1, with the expander closed.

The expandable portion 22 may be put into a closed position, as shown in FIG. 2, with the use of a compression mechanism such as an expander zipper 28. The expander zipper 28 may include a first and second set of teeth 30, 32 that are attached around the circumference (not shown) of the mattress cover 10. The manner of attachment of the sets of teeth 30, 32 may include sewn attachments or adhesive attachments, for examples.

In another embodiment, an insertion layer 36 may be included on top of or underneath the expandable portion 22. FIGS. 1 and 2 show the insertion layer 36 located on top of the expandable portion 22. The insertion layer 36 includes one or more user-accessible pockets 38. The pocket 38 may be sized to accept a mattress insert (not shown). A mattress insert may be, for example, a layer of memory foam. The pocket 38 may be generally rectangular in shape, and may have the same rectangular shape as the bottom panel 14. The pocket 38 may also be accessible through an opening, and the opening may be opened or closed with the use of an insertion layer zipper 40. The pocket 38 and opening or zipper 40 allows a user to insert or remove one or more additional mattress layer within the mattress 12. The insertion later zipper 40 may extend along at least one of the four sides of the insertion layer 36 to allow access into the insertion layer pocket 38. As shown in FIGS. 1 and 2, the insertion layer 36 may be generally included within a mattress cover 10, and may also be included with the expandable portion 22.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. An apparatus for selectively altering a mattress' thickness and/or firmness, comprising an outer covering having a top perimeter and a bottom perimeter, the space in between the perimeters defining a thickness, and wherein the top and bottom perimeters are substantially alignable with the perimeter of a mattress to be altered;

an inner compressible material, the inner compressible material having a top surface and a bottom surface, held within the covering;

a compression mechanism including a first zipper attached to the top and bottom perimeters of the outer covering, capable of reversibly compressing the compressible material, by connecting the top and bottom perimeters together, such that compression of the compressible material is accomplished by reducing a distance between the top and bottom surfaces of the compressible material, wherein the covering is attachable to a mattress; and a pocket having the shape of the mattress, the pocket having an opening along a single side of the pocket, the opening bordered by a second zipper, the pocket sized to accept a mattress insert, and wherein the pocket is attachable on at least one side to a mattress.

2. An apparatus for selectively altering a mattress' thickness and/or firmness, comprising a pocket having the shape of a mattress, the pocket having an opening, wherein the pocket is sized to accept one or more mattress inserts, such that the inserts may be stacked on top of each other to compress inserts, and wherein the pocket is attachable on at least one side to a mattress with the opening located on a side of the pocket which is selectively opened or closed by a first zipper located only along the second side, and further including an outer covering having a perimeter substantially alignable with a perimeter of the mattress, an inner compressible material held within the covering, and a compression mechanism capable of reversibly compressing the compressible material by means of a second zipper which surrounds a majority of the perimeter of the mattress, wherein the covering is attachable to a mattress.

3. The apparatus of claim 2 wherein the pocket is rectangular in shape and the opening extends along at least one side of the pocket.

4. An apparatus for selectively altering a mattress' thickness, comprising an outer covering having a perimeter substantially alignable with the perimeter of a mattress to be altered;

an inner compressible material held within the covering having a vertical thickness;

a compression mechanism capable of reversibly compressing the compressible material by reducing the vertical thickness of the inner compressible material, wherein the covering is attachable to a mattress; and a pocket having the shape of a mattress, the pocket having an opening, wherein the pocket is sized to accept a mattress insert, and wherein the pocket is attachable on at least one side to a mattress.

* * * * *